US007965959B2

(12) United States Patent
Ishikawa

(10) Patent No.: US 7,965,959 B2
(45) Date of Patent: Jun. 21, 2011

(54) TRANSFER APPARATUS AND IMAGE FORMING DEVICE

(75) Inventor: Takatoshi Ishikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 367 days.

(21) Appl. No.: 12/235,250

(22) Filed: Sep. 22, 2008

(65) Prior Publication Data

US 2009/0208259 A1 Aug. 20, 2009

(30) Foreign Application Priority Data

Feb. 14, 2008 (JP) ..... 2008-033695

(51) Int. Cl.
*G03G 15/08* (2006.01)

(52) U.S. Cl. ..... 399/121; 399/302; 399/313; 399/314

(58) Field of Classification Search ..... 399/121, 399/297, 302, 313, 314
See application file for complete search history.

(56) References Cited

U.S. PATENT DOCUMENTS 5,884,133 A * 3/1999 Morimoto et al. ..... 399/313
2002/0159801 A1 10/2002 Nakashima et al. ..... 399/307

FOREIGN PATENT DOCUMENTS

JP 03-192283 8/1991
JP 2003-149953 5/2003
JP 2004/333521 11/2004

* cited by examiner

*Primary Examiner* — David M Gray
*Assistant Examiner* — Barnabas T Fekete
(74) *Attorney, Agent, or Firm* — Morgan, Lewis & Bockius LLP

(57) ABSTRACT

A transfer apparatus includes a transfer belt that conveys a toner image which has been transferred to an outer periphery face thereof; a transfer member that, at a contact portion, causes the toner image to be transferred from the outer periphery face of the transfer belt to a recording medium; an opposing roller that is disposed to oppose the transfer member at an inner periphery side of the transfer belt; an opposing belt that is wound round the opposing roller; and a tension member that is disposed at an upstream side of a conveyance direction of the transfer belt relative to the opposing roller, the opposing belt being wound round the tension member, and the tension member causing the opposing belt to touch against the inner side of the transfer belt at the upstream side relative to the contact portion.

12 Claims, 5 Drawing Sheets

TRANSFER APPARATUS AND IMAGE FORMING DEVICE

CROSS-REFERENCE TO RELATED APPLICATIONS

This application is based on and claims priority under 35 USC 119 from Japanese Patent Application No. 2008-033695 filed Feb. 14, 2008.

BACKGROUND OF THE INVENTION

1. Technical Field

The present invention relates to a transfer apparatus and an image forming device.

2. Related Art

Heretofore, in image forming devices such as printers, copiers and the like, a transfer apparatus has been employed which sequentially primary-transfers and superposes toner images of respective colors onto an intermediate transfer belt, and secondary-transfers the superposed toner images from the intermediate transfer belt onto a recording medium.

However, a technical problem has been apparent in that when image formation is performed using an intermediate transfer belt with high electrical resistance, fish scale-like image defects (below referred to as "scale-form defects") are formed in the image that has been transferred onto paper. The present inventors have investigated these image defects and have discovered that the scale-form defects arise in accordance with gap discharges that occur between the intermediate transfer belt and a backup roller at a pre-nipping region which is positioned immediately preceding a nipping region (a transfer nipping region) where the paper enters into between the intermediate transfer belt and the secondary transfer roller.

These gap discharges are positive discharges, and it is known that positive discharges form charge patterns with round scale shapes. A scale shaped charge pattern formed at the rear face of an intermediate transfer belt is more likely to be maintained when electrical resistance of the intermediate transfer belt is higher. Then, when the toner moves from the intermediate transfer belt to the paper, the scale shaped charge pattern at the rear face of the belt takes effect, and a scale pattern is formed on the paper.

In particular, when a "spherical toner" with high transfer efficiency is employed as the toner, to the extent that adhesion force of the toner is lower, the toner is more easily detached from the intermediate transfer belt by weak discharges. Consequently, the scale-form defects are more likely to occur.

SUMMARY

A transfer apparatus of a first aspect of the present invention includes: a transfer belt that conveys a toner image which has been transferred to an outer periphery face thereof; a transfer member that, at a contact portion, causes the toner image to be transferred from the outer periphery face of the transfer belt to a recording medium; an opposing roller that is disposed to oppose the transfer member at an inner periphery side of the transfer belt; an opposing belt that is wound round the opposing roller; and a tension member that is disposed at an upstream side of a conveyance direction of the transfer belt relative to the opposing roller, the opposing belt being wound round the tension member, and the tension member causing the opposing belt to touch against the inner side of the transfer belt at the upstream side relative to the contact portion.

BRIEF DESCRIPTION OF THE DRAWINGS

Embodiments of the present invention will be described in detail based on the following figures, wherein.

DETAILED DESCRIPTION

Figure 1:
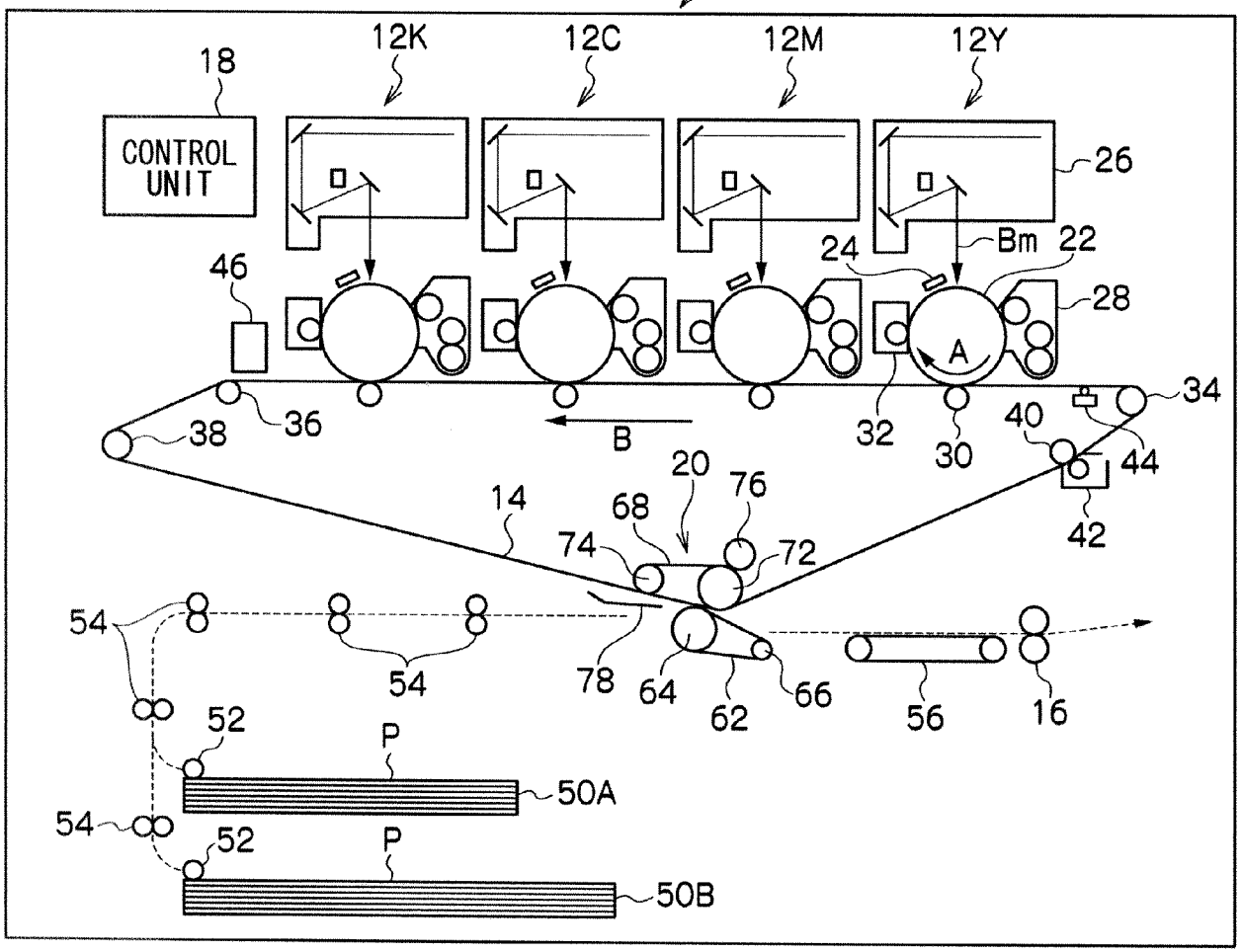
FIG. 1 is a structural diagram of an image forming device relating to a first exemplary embodiment of the present invention.

A first exemplary embodiment of a transfer apparatus and an image forming device of the present invention will be described on the basis of the drawings. FIG. 1 shows a printer 10, which serves as the image forming device.

The printer 10 is provided with plural image forming units 12 (12Y, 12M, 12C and 12K), an intermediate transfer belt 14, a secondary transfer apparatus 20, and a fixing section 16. The image forming units 12 form toner images of respective color components by an electrophotography system. The intermediate transfer belt 14 sequentially transfers (primary-transfers) and retains the toner images of the respective color components that have been formed at the image forming units 12. The secondary transfer apparatus 20 transfers (secondary-transfers) the toner images that have been transferred and superposed on the intermediate transfer belt 14, all together, onto a recording paper P which serves as a recording medium. The fixing section 16 fixes the toner image that has been secondary-transferred onto the recording paper P. A control device 18 is also included, which controls operations of the respective devices (sections).

At each of the image forming units 12 (12Y, 12M, 12C and 12K), a charging unit 24, a laser exposure unit 26, a developing device 28, a primary transfer roller 30 and a cleaning unit 32 are disposed in this order around a photosensitive drum 22, which turns in the direction of arrow A. The charging unit 24 electrostatically charges the photosensitive drum 22. The laser exposure unit 26 forms an electrostatic latent image on the photosensitive drum 22 with an exposure beam Bm. The developing device 28 accommodates toner of the respective color component and develops the electrostatic latent image on the photosensitive drum 22 visible with the toner. The primary transfer roller 30 transfers the toner image of the respective color component that has been formed on the photosensitive drum 22 to the intermediate transfer belt 14. The cleaning unit 32 removes residual toner on the photosensitive drum 22. From an upstream side of a movement direction of the intermediate transfer belt 14, the image forming units 12 are disposed in a linear arrangement in the order yellow (Y), magenta (M), cyan (C) and black (K).

The toner of each color is negatively charged, being particles formed by adding a colorant and wax to a binder resin, such as polyester, styrene acryl or the like, by a suspension polymerization method, an emulsion-agglomeration method, a dissolution suspension method or the like. The particles have a volume average particle diameter of approximately 5.8 μm, a measurement result according to a Coulter counter (produced by Beckman Coulter, Inc.), and a particle distribution index (GSD) of 1.23. As an index for the above-mentioned particle size distribution, using D16 and D84 of the cumulative distribution a volume GSD is obtained (volume GSD=(volume D84/volume D16)$^{1/2}$).

The intermediate transfer belt 14 may be structured of resin material, may be structured of rubber material, and may have a multilayer structure formed of resin material and rubber material. As necessary, one or plural types of a conducting agent that provides electrical conductivity, a conducting agent that provides ion conductivity, and the like are suitably combined and added.

A conducting agent that provides electrical conductivity may be a metal or alloy such as carbon black, graphite, aluminium, nickel, a copper alloy or the like; a metal oxide such as tin oxide, zinc oxide, potassium titanate, a tin oxide-indium oxide composite oxide or tin oxide-antimony oxide composite oxide or the like.

As a conducting agent that provides ion conductivity, there are sulfonates, ammonium salts and the like, and various surfactants of cationic types, anionic types, nonionic types and the like. There is also a method in which a conductive polymer is blended.

The intermediate transfer belt 14 that is employed includes a suitable quantity of a conducting agent such as carbon black or the like in a resin such as a polyimide, a polyamide or the like, and is structured by a film-form endless belt with a surface resistivity of at least $1\times10^{12}$ (Ω/sq.) and a thickness of 80 μm, so as to easily retain toner.

A method for measuring resistance of the intermediate transfer belt 14 is illustrated below.

A resistance value R Ω is measured using a micro current meter R8340A produced by Advantest Corporation as a measuring instrument, an HR probe produced by Mitsubishi Petrochemical Corporation as a probe (main electrode external diameter d=1.6 cm, guard electrode internal diameter D=3.0 cm), and a table from Mitsubishi Petrochemical Corporation as a measurement table (an insulative face for when measuring surface resistivity and a conductive face for when measuring volume resistivity), with an applied voltage of 100 V, a load of 2 kg and a measurement duration of 30 s. The surface resistivity Rs (Ω/sq.) is calculated by $Rs=2\times\pi\times R/\ln(D/d)$, and the volume resistivity Rv (Ω·cm) is calculated by $Rv=\pi\times(d^2)\times R/t$, in which t is the thickness (cm) of the test sample (i.e., the intermediate transfer belt 14).

The intermediate transfer belt 14 is provided with a driving roller 34, a support roller 36, a tension roller 38 and a cleaning backup roller 40. The driving roller 34 is driven by a motor with excellent speed stability (not shown) and drives the intermediate transfer belt 14 to circulate. The support roller 36 supports a linear portion of the intermediate transfer belt 14 along the direction of arrangement of the photosensitive drums 22. The tension roller 38 provides a constant tension to the intermediate transfer belt 14 and prevents meandering of the intermediate transfer belt 14. The cleaning backup roller 40 is provided at a cleaning section that scrapes off residual toner on the intermediate transfer belt 14. Rollers in the area of the secondary transfer apparatus 20 will be described later. The intermediate transfer belt 14 stretches between the various rollers and is driven to circulate (turned) at a constant speed in the direction of arrow B.

A voltage of opposite polarity to the charge polarity of the toner is applied to the primary transfer roller 30 opposing each photosensitive drum 22. Thus, the toner images on the respective photosensitive drums 22 are sequentially electrostatically attracted to the intermediate transfer belt 14, and a superposed toner image is formed on the intermediate transfer belt 14.

A belt cleaner 42 is provided at the intermediate transfer belt 14 at the downstream side of the secondary transfer apparatus 20. The belt cleaner 42 removes residual toner, paper dust and the like on the intermediate transfer belt 14 after secondary transfer, cleaning the surface of the intermediate transfer belt 14.

A reference sensor (home position sensor) 44 is disposed at the upstream side of the image forming unit 12Y. The reference sensor 44 generates a reference signal which serves as a reference for setting image formation timings at the image forming units 12 (12Y, 12M, 12C and 12K). An image density sensor 46 is disposed at the downstream side of the image forming unit 12K, for image quality regulation. The reference sensor 44 detects predetermined marks provided on the intermediate transfer belt 14 and generates the reference signal. The image forming units 12 begin image formation in accordance with instructions from the control device 18 which are based on detection of the reference signal.

Paper trays 50A and 50B which load recording papers P are disposed at a lower portion of the printer 10. At an end portion of one of the paper trays 50A and SOB, a paper feed roller 52 is provided. The paper feed roller 52 draws out and conveys the loaded recording paper P at predetermined timings. The recording paper P taken out by the paper feed roller 52 is fed in to the secondary transfer apparatus 20 by plural pairs of conveyance rollers 54. A conveyance belt 56 is provided at a downstream side of the secondary transfer apparatus 20 in a conveyance direction of the recording paper P. The conveyance belt 56 conveys the recording paper P, to which a toner image has been secondary-transferred, to the fixing section 16.

Next, a basic image formation process of the printer 10 will be described. First, image data outputted from an unillustrated image reading device, personal computer (PC) or the like is inputted to the printer 10. In the printer 10, predetermined image processing is applied by an unillustrated image processing device, and then image creation is carried out by the image forming units 12 and the like.

At the unillustrated image processing device, predetermined image processing is applied to inputted reflection data, such as shading correction, mispositioning correction, brightness/color space conversion, gamma correction, frame erasure and color editing, translation editing, and the like. The image data to which the image processing has been applied is converted to colorant level data of the four colors yellow (Y), magenta (M), cyan (C) and black (K), and outputted to the laser exposure units 26.

At the laser exposure units 26, the exposure beams Bm are emitted from semiconductor lasers in accordance with the inputted colorant level data. The exposure beams Bm are irradiated at the respective photosensitive drums 22 of the image forming units 12Y, 12M, 12C and 12K. At the photosensitive drum 22 of each image forming unit 12Y, 12M, 12C or 12K, after the surface has been charged up by the charging unit 24, the surface is scanningly exposed by the laser exposure unit 26 and an electrostatic latent image is formed. At each of the image forming units 12Y, 12M, 12C and 12K, the electrostatic latent image that has been formed is developed to form a toner image of the respective color yellow (Y), magenta (M), cyan (C) or black (K).

The toner images that have been formed on the photosensitive drums 22 of the image forming units 12Y, 12M, 12C and 12K are sequentially superposed on the surface of the intermediate transfer belt 14 at primary transfer portions at which the photosensitive drums 22 and the intermediate transfer belt 14 abut. Thus, primary transfer is implemented. A primary-transferred unfixed toner image is conveyed to the secondary transfer apparatus 20 with the turning of the intermediate transfer belt 14.

Meanwhile, in a paper conveyance unit, the paper feed roller 52 turns in association with the timing of image formation, and recording paper P of a predetermined size is supplied from the paper tray 50A or the paper tray 50B. The recording paper P that has been fed out by the paper feed roller 52 is conveyed by the conveyance rollers 54 and reaches the secondary transfer apparatus 20. Before reaching the secondary transfer apparatus 20, the recording paper P is temporarily stopped and a position of the paper is matched with a position of the toner image, by a registration roller (not shown) turning to match a movement timing of the intermediate transfer belt 14 at which the toner image is being retained.

Then, the toner image is electrostatically transferred from the intermediate transfer belt 14 to the recording paper P at the secondary transfer apparatus 20, and the recording paper P is separated from the intermediate transfer belt 14 and conveyed to the conveyance belt 56. On the conveyance belt 56, the recording paper P is conveyed to the fixing section 16, matching an optimum conveyance speed of the fixing section 16. The unfixed toner image on the recording paper P is subjected to a fixing treatment with heat and pressure at the fixing section 16, and thus is fixed onto the recording paper P. The recording paper P on which the fixed image has been formed is outputted to outside the printer 10 by an ejection roller (not shown).

After transfer of the toner image onto the recording paper P has been completed, residual toner remaining on the intermediate transfer belt 14 is conveyed to the cleaning section with the turning of the intermediate transfer belt 14, and is removed from the intermediate transfer belt 14 by the cleaning backup roller 40 and belt cleaner 42.

Next, the secondary transfer apparatus 20 will be described.

Figure 2A:
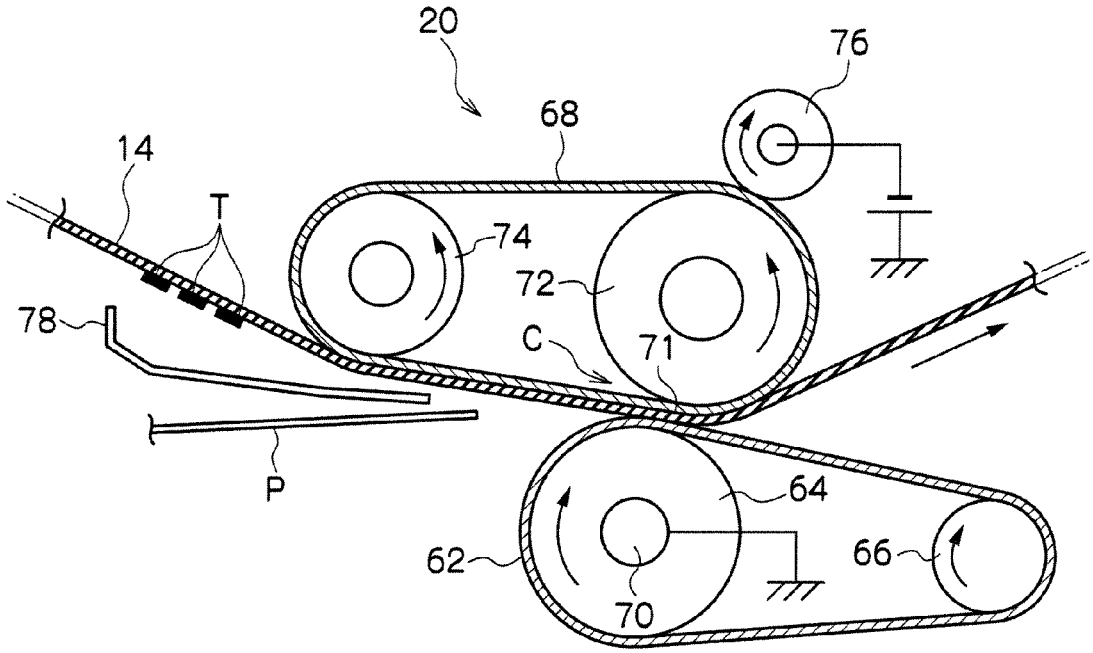
FIG. 2A and FIG. 2B are sectional diagrams of a secondary transfer apparatus relating to the first exemplary embodiment of the present invention.

As shown in FIG. 2A, the secondary transfer apparatus 20 includes a transfer conveyance belt 62 and an opposing belt 68. The transfer conveyance belt 62 is disposed to touch against a toner image-retaining surface side of the intermediate transfer belt 14, and the opposing belt 68 is disposed to touch against an inner face side of the intermediate transfer belt 14.

The transfer conveyance belt 62 is a semiconductive endless belt with a volume resistivity of $10^6$ to $10^{10}$ Ω·cm, and is wound round a transfer roller 64 and a following roller 66. The transfer roller 64 is rotatably provided and serves as one of electrodes that form a secondary transfer electric field. The following roller 66 is rotatably provided and is disposed to be parallel with the transfer roller 64 at the intermediate transfer belt 14 conveyance direction downstream side thereof.

The transfer roller 64 is formed with, at the surface thereof, a tube of urethane in which carbon is dispersed and, at the interior, foam urethane rubber in which carbon is dispersed. The surface is subjected to fluorine coating. The transfer roller 64 is formed with a volume resistance of $10^5$ to $10^7$Ω, a roller diameter of 28 mm and a hardness of 20° to 50° (Asker C). A hardness of 35° is specified here. The transfer roller 64 is also provided with a rotation axle 70 formed of a metal such as SUS steel or the like. An unillustrated driving mechanism structured with gears and a motor is attached to an end portion of the rotation axle 70.

The driving mechanism of the transfer roller 64 is controlled for driving by the control device 18 (see FIG. 1), rotates the transfer roller 64, and moves the transfer conveyance belt 62. A rotation axle of the following roller 66 (not shown) and the rotation axle 70 of the transfer roller 64 are fixed at a certain distance, in order to tense and tauten the transfer conveyance belt 62. The rotation axle 70 is connected with wiring and earthed.

The opposing belt 68 has a smaller surface resistivity than the intermediate transfer belt 14, and is, for example, an endless belt with a surface resistivity of $1\times10^{10.5}$ (Ω/sq.). The opposing belt 68 is structured by an elastic member formed of chloroprene rubber.

The opposing belt 68 may be structured of resin material, may be structured of rubber material, and may have a multilayer structure formed of resin material and rubber material.

The resin material may be, for example, a polyimide resin, a polyamideimide resin, a fluorine-based resin, a vinyl chloride-vinyl acetate copolymer, a polycarbonate resin, a polyethylene terephthalate resin, a vinyl chloride-based resin, an ABS resin, a polymethylmethacrylate resin, a polybutylene terephthalate resin or the like. These may be used singly or in a combination of two or more. Among these, a polyimide resin is excellently employed in view of being excellent in both strength and flexing fatigue characteristics.

The rubber material may be isoprene rubber, chloroprene rubber, epichlorhydrine rubber, butyl rubber, urethane rubber, silicone rubber, fluorine rubber, SBR, NBR, EPDM, an acrylonitrile-butadiene-styrene rubber, a blend of these, or the like. Of these, isoprene rubber, silicone rubber and EPDM can be preferably employed.

Accordingly, the opposing belt 68 resiliently deforms and follows the intermediate transfer belt 14, and a degree of tightness of contact with the intermediate transfer belt 14 is raised.

Meanwhile, the opposing belt 68 is wound round a following roller 72 and an auxiliary roller 74. The following roller 72 is rotatably provided and serves as the other of the electrodes that form the secondary transfer electric field. The auxiliary roller 74 is rotatably provided and is disposed to be parallel with the following roller 72 at the intermediate transfer belt 14 conveyance direction upstream side thereof. The opposing belt 68 turns following the intermediate transfer belt 14.

The following roller 72 is formed with, at the surface side thereof, a tube of a blend rubber of EPDM and NBR in which carbon is dispersed and, at the inner side thereof, EPDM rubber. The following roller 72 is formed with a surface resistivity of between $1\times10^7$ (Ω/sq.) and $1\times10^{11}$ (Ω/sq.), a roller diameter of 28 mm and a hardness of 50° to 70° (Asker C). A hardness of 60° is specified here, which is harder than the transfer roller 64.

Between the transfer roller 64 and the following roller 72, the transfer conveyance belt 62, the intermediate transfer belt 14 and the opposing belt 68 are disposed pressed together. Herein, a portion (region) where the transfer conveyance belt 62 and the intermediate transfer belt 14 are pressed is referred to as a contact portion 71. Further, a region bounded by the opposing belt 68 and the following roller 72 is referred to as a wedge region C. The following roller 72 is not earthed.

An urging force is applied to the auxiliary roller 74, by an unillustrated spring or the like, in a direction away from the following roller 72 and in a direction in which the opposing belt 68 touches against the intermediate transfer belt 14. As a result, the auxiliary roller 74 causes the opposing belt 68 that is wound therearound to touch against the inner side of the intermediate transfer belt 14 at the upstream side relative to the contact portion 71. The auxiliary roller 74 follows along with movement of the opposing belt 68, suppresses new triboelectric charging with the opposing belt 68, and preserves a state of charging of the opposing belt 68. The auxiliary roller 74 is connected with unillustrated wiring and is earthed.

Sandwiching the opposing belt 68, a charging roller 76, formed of a metallic roll of SUS or the like, is disposed to touch against the opposite side of the opposing belt 68 from the side at which the following roller 72 is disposed. The charging roller 76 is supported at two end portions and is rotatable, and turns together with the opposing belt 68. A secondary transfer bias of the same polarity as the toner (negative polarity in the present exemplary embodiment) is applied to the charging roller 76 from an unillustrated secondary transfer bias power supply, which serves as a bias application section, in accordance with the control device 18 (see FIG. 1). The secondary transfer bias is −6 kV.

A conveyance guide 78 is provided at the recording paper P conveyance direction upstream side of the contact portion 71. The conveyance guide 78 guides the recording paper P that has been conveyed thereto to the contact portion 71

Next, operation of the first exemplary embodiment of the present invention will be described.

Figure 2B:
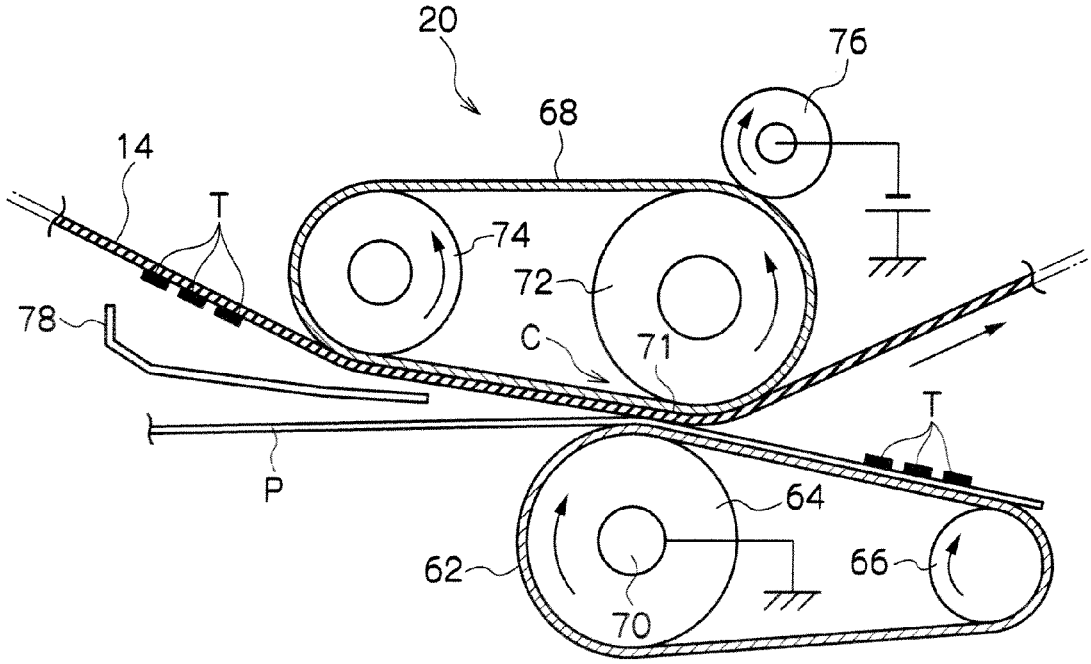

As shown in FIG. 1, FIG. 2A and FIG. 2B, the aforementioned steps of charging, exposure, development and primary transfer are carried out in the printer 10, and unfixed toner T that has been primary-transferred is conveyed to the secondary transfer apparatus 20 in accordance with the turning of the intermediate transfer belt 14. Meanwhile, the recording paper P is conveyed to the secondary transfer apparatus 20 from the paper tray 50A or 50B.

At the secondary transfer apparatus 20, the following roller 72 is charged to negative polarity by the charging roller 76 via the opposing belt 68, and the secondary transfer electric field is formed by a potential difference between the earthed transfer roller 64 and the following roller 72. Here, the secondary transfer electric field is an electric field with higher potential at the transfer roller 64 side and lower potential (the negative polarity) at the following roller 72 side.

Then, at the contact portion 71, the toner T on the intermediate transfer belt 14 is electrostatically attracted toward the transfer roller 64 by the secondary transfer electric field between the following roller 72 and the transfer roller 64, and is transferred onto the recording paper P.

Figure 3A:
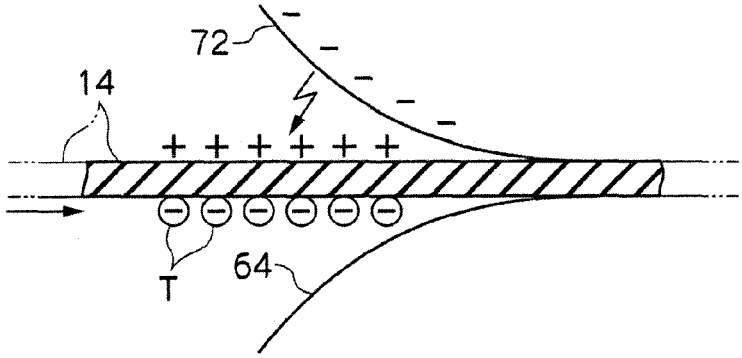
FIG. 3A RELATED ART
FIG. 3A to FIG. 3C are schematic diagrams showing electrostatic conditions at an intermediate transfer belt of a Comparative Example with the present invention.
Figure 3B:
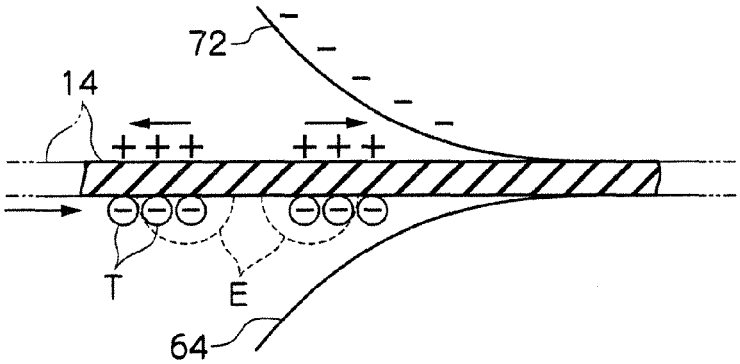
FIG. 3B RELATED ART
Figure 3C:
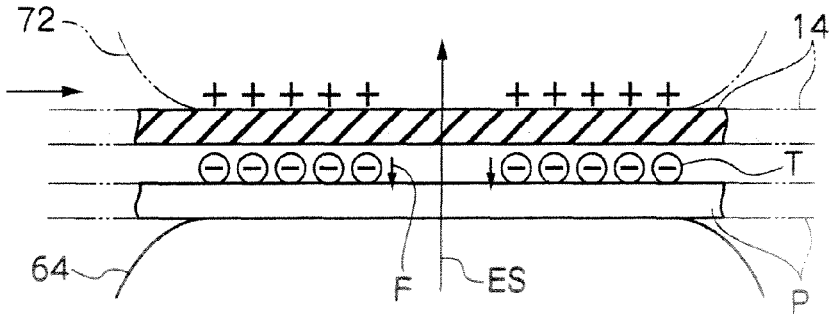

Now states of charging of the intermediate transfer belt 14 will be described. FIG. 3A to FIG. 3C are schematic diagrams of a contact portion vicinity in a case in which only the transfer roller 64 and the following roller 72 are employed, without the transfer conveyance belt 62 and the opposing belt 68 being employed, which serves as a Comparative Example with the present invention As shown in FIG. 3A, the inner face of the intermediate transfer belt 14 to which the negative polarity toner T has been transferred by the primary transfer is charged to positive polarity. Meanwhile, the surface of the following roller 72 is charged to negative polarity. Now, because a high voltage of several kV is applied between the transfer roller 64 and the following roller 72, and the resistance of the intermediate transfer belt 14 is high, a potential difference (of a gap) between the following roller 72 and the intermediate transfer belt 14 is at or above the Paschen discharge limit voltage, and positive-polarity discharges occur in this gap.

Hence, as shown in FIG. 3B, due to a gap discharge between the following roller 72 and the intermediate transfer belt 14, the inner face of the intermediate transfer belt 14 is locally charged and a charge dispersion is caused. However, because the resistance of the intermediate transfer belt 14 is high, charge tends not to move, and an in-plane electric field is formed along the inner face of the intermediate transfer belt 14. An electric field E is generated at the front face of the intermediate transfer belt 14 by this in-plane electric field. The toner T retained at the front face of the intermediate transfer belt 14 is moved by the electric field E, and regions of sparsity and density are formed in the distribution of the toner T on the intermediate transfer belt 14.

Because in-plane electric fields are generated at the inner face of the intermediate transfer belt 14, the electric field between the intermediate transfer belt 14 and the following roller 72 is weakened, and gap discharges do not occur for some time. If the electric field across the gap is re-strengthened, gap discharges will occur, and regions of sparsity and density will be formed in the distribution of the toner T on the intermediate transfer belt 14.

Subsequently, as shown in FIG. 3C, the recording paper P enters the contact portion between the following roller 72 and the transfer roller 64. An electrostatic attractive force F acts on the toner T due to the secondary transfer electric field ES between the following roller 72 and the transfer roller 64, and the toner T is secondary-transferred from the intermediate transfer belt 14 onto the recording paper P. According to the descriptions herein, the intermediate transfer belt 14 and the recording paper P are separated, but in practice the toner T touches against both of them.

Because there are deviations in density states in the distribution of toner T on the intermediate transfer belt 14, the image of toner T on the recording paper P is absent from original locations at which the toner T was intended to be disposed, and this is visually apparent as scale-form irregularities. In particular, when spherical toner with a small shape coefficient is employed as the toner T, although transferability is good, the toner T come under the influence of small changes in electric field resulting from discharges and the like and may be scattered on the intermediate transfer belt 14 or on the recording paper P by, and the scale-form irregularities become obvious.

Figure 4A:
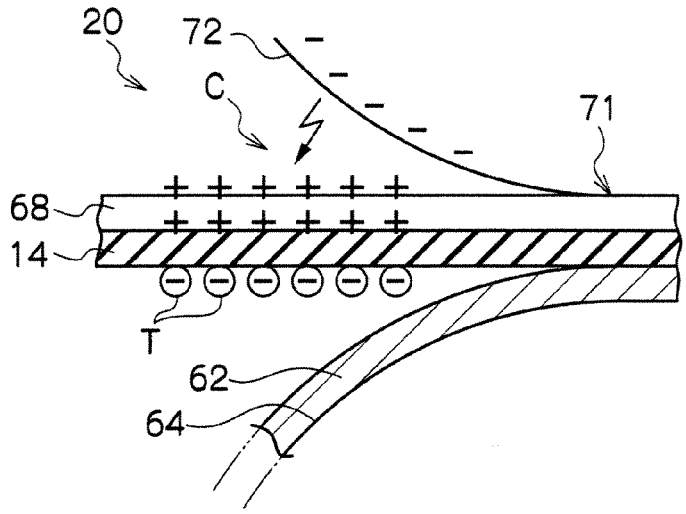
FIG. 4A to FIG. 4C are schematic diagrams showing electrostatic conditions at an intermediate transfer belt of the secondary transfer apparatus relating to the first exemplary embodiment of the present invention.
Figure 4B:
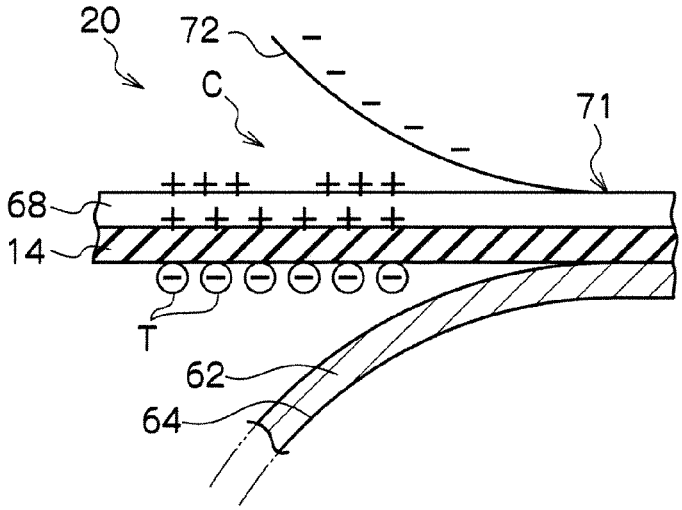
Figure 4C:
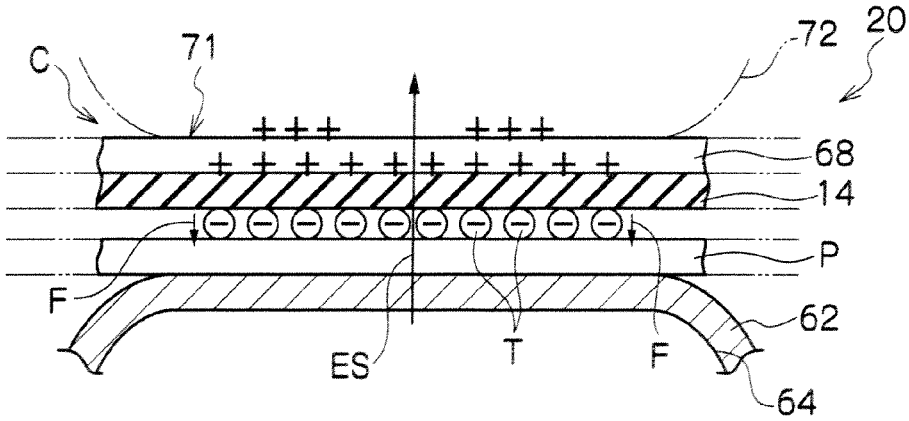

Next, states of charging of the intermediate transfer belt 14 of the secondary transfer apparatus 20 of the present embodiment will be described. FIG. 4A to FIG. 4C are schematic diagrams of the vicinity of the contact portion 71.

As shown in FIG. 4A, the inner face of the intermediate transfer belt 14 to which the negative polarity toner T has been transferred by primary transfer is charged to positive polarity. The inner face of the opposing belt 68 that touches against the intermediate transfer belt 14 and is conveyed to the contact portion 71 is also charged to positive polarity. In contrast, the surface of the following roller 72 is charged to negative polarity.

The high voltage of several kV is applied between the transfer roller 64 and the following roller 72. In the wedge region C, a potential difference of a gap between the following roller 72 and the opposing belt 68 is at or above the Paschen discharge limit voltage, and positive-polarity discharges occur.

Hence, as shown in FIG. 4B, due to a gap discharge between the following roller 72 and the opposing belt 68, the inner face of the opposing belt 68 is locally charged and a charge dispersion is caused. Here, because the opposing belt 68 has low resistance, charge is scattered along the inner face of the opposing belt 68. Therefore, a charge distribution of the opposing belt 68 has smaller irregularities in density states than the intermediate transfer belt 14 in FIG. 3A to FIG. 3C, and has almost no effect on the charge distribution at the inner face of the intermediate transfer belt 14. Thus, the charge distribution at the inner face of the intermediate transfer belt 14 is kept the same as at the primary transfer, and the distribution of the toner T is maintained.

Subsequently, as shown in FIG. 4C, the recording paper P enters the contact portion 71 between the following roller 72 and the transfer roller 64. The electrostatic attractive force F acts on the toner T due to the secondary transfer electric field ES between the following roller 72 and the transfer roller 64, and the toner T is secondary-transferred from the intermediate transfer belt 14 onto the recording paper P. The image of toner T on the recording paper P is present at the original locations at which the toner T was intended to be disposed, and scale-form irregularities are barely measurable.

Then, as shown in FIG. 2B, the recording paper P onto which the toner T has been secondary-transferred is fed out from the contact portion 71. Here, the surface of the transfer conveyance belt 62 has been charged up by contact with the recording paper P, and acts to retain the recording paper P by electrostatic attraction. Consequently, the recording paper P is peeled off from the intermediate transfer belt 14, and is conveyed along the transfer conveyance belt 62. Thereafter, the recording paper P is fixed at the fixing section 16 (see FIG. 1), and image formation ends.

Next, results of evaluation of the present invention and the Comparative Example, regarding whether or not scale-form defects occur in an image of toner T on recording paper P and transferability of the toner T, are shown in table 1. Transferability was evaluated in association with scale-form defect occurrences because the probability of discharge occurrences is smaller and scale-form defect occurrences are suppressed when the secondary transfer bias is lower, but if the secondary transfer bias is too low, transfer does not occur.

The scale-form defect occurrence evaluation was implemented by printing—in a low temperature and low humidity environment (temperature 10° C., humidity 15%) and on recording paper P which had been conditioned for 24 hours—a gradation pattern in which image density was set in steps of 10% intervals from 100% to 10%, for each of single colors, multiple colors and triple colors, and visually inspecting for the presence or absence of scale-form irregularities. Papers on which scale irregularities were not visually identified were evaluated as Good, papers on which the overall image was not affected but slight scale irregularities were visible in parts were evaluated as Fair, and papers on which numerous scale irregularities were visually identified were evaluated as Poor, For the transferability evaluation, densities of toner T on recording paper P after secondary transfer in the same environment as the scale-form defect occurrence evaluation were measured, and were evaluated as Good. Fair or Poor by comparison with tolerance values of pre-specified densities.

In the evaluations, a secondary transfer bias applied to the contact rollers (i.e., the transfer roller 64 and the following roller 72) was adjusted in a range from −5.0 to −7.0 kV such that the multicolor (secondary color and tertiary color) toner images could be transferred at the time of printing.

TABLE 1

Scale occurrence and transferability evaluation results

| Voltage applied | Present invention | | Comparative Example | |
|---|---|---|---|---|
| to contact rollers (−kV) | Scale-form defects occurrences | Toner transferability | Scale-form defects occurrences | Toner transferability |
| 5.0 | Good | Fair | Fair | Fair |
| 5.5 | Good | Fair | Fair | Fair |
| 6.0 | Good | Good | Poor | Good |

TABLE 1-continued

Scale occurrence and transferability evaluation results

| Voltage applied | Present invention | | Comparative Example | |
|---|---|---|---|---|
| to contact rollers (−kV) | Scale-form defects occurrences | Toner transferability | Scale-form defects occurrences | Toner transferability |
| 6.5 | Good | Good | Poor | Good |
| 7.0 | Good | Good | Poor | Good |

As shown in table 1, in the scale-form defect occurrence evaluation, scale-form defect occurrences were not seen in cases of secondary transfer by the secondary transfer apparatus 20 of the present invention with secondary transfer biases in the range from −5.0 to −7.0 kV. In the Comparative Example, scale-form defect occurrences were seen in a range from −5.0 to −7.0 kV. In the transferability evaluation, the present invention and the Comparative Example had similar trends, transferability being at practical levels with secondary transfer biases of −5.0 to −7.0 kV.

Next a second exemplary embodiment of a transfer apparatus and image forming device of the present invention will be described on the basis of the drawings. Components that are basically the same as in the above-described first exemplary embodiment are assigned the same reference numerals as in the first exemplary embodiment and will not be described.

Figure 5A:
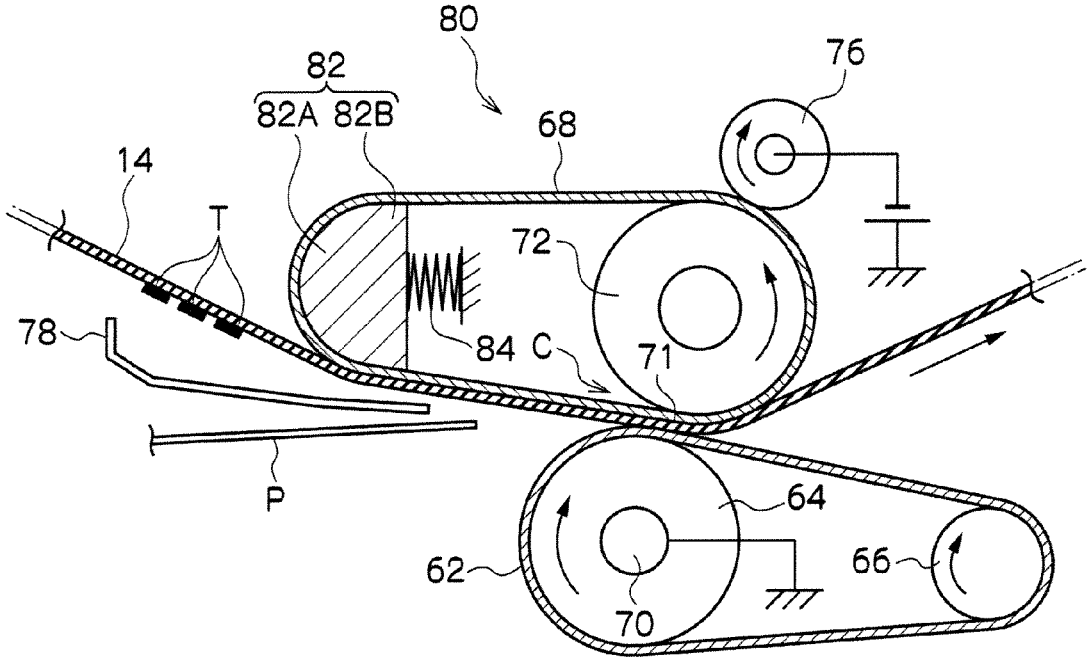
FIG. 5A and FIG. 5B are sectional diagrams of a secondary transfer apparatus relating to a second exemplary embodiment of the present invention.

FIG. 5A shows a secondary transfer apparatus 80. The secondary transfer apparatus 80 is the secondary transfer apparatus 20 of the first exemplary embodiment provided with a pushing member 82 and a spring 84 in place of the auxiliary roller 74.

The pushing member 82 is structured with a contact portion 82A and a flat attachment portion 82B. The contact portion 82A has a substantially semi-circular shape in a sectional view and touches against the inner face of the opposing belt 68. The spring 84 is attached to the attachment portion 82B. One end of the spring 84 is attached to the attachment portion 82B such that an attachment face direction and an urging direction are substantially orthogonal. The other end of the spring 84 is fixed to an unillustrated housing of the secondary transfer apparatus 80.

Next, operation of the second exemplary embodiment of the present invention will be described.

The pushing member 82, which is urged by the spring 84, tenses the opposing belt 68 and presses the opposing belt 68 against the inner face of the intermediate transfer belt 14 with a predetermined pushing force. As a result, the face of the opposing belt 68 at the side thereof that opposes the intermediate transfer belt 14 becomes substantially linear, tension in the intermediate transfer belt 14 becomes constant, and tightness of contact between the opposing belt 68 and the intermediate transfer belt 14 is raised.

Subsequently, when the intermediate transfer belt 14 to which the toner T has been primary-transferred advances into the contact portion 71, because a high voltage of several kV is applied between the transfer roller 64 and the following roller 72, in the wedge region C, the potential difference of the gap between the following roller 72 and the opposing belt 68 is at or above the Paschen discharge limit voltage, and positive-polarity discharges occur.

Due to these discharges, the inner face of the opposing belt 68 is locally charged and charge dispersions are caused. Because the opposing belt 68 has low resistance, charge is scattered along the inner face of the opposing belt 68. Therefore, a charge distribution of the opposing belt 68 has small irregularities in density states, and has almost no effect on the charge distribution at the inner face of the intermediate transfer belt 14.

Moreover, because the opposing belt 68 and the intermediate transfer belt 14 are tightly contacted and there are no new gaps therebetween, discharges do not occur between the opposing belt 68 and the intermediate transfer belt 14. Thus, the charge distribution at the inner face of the intermediate transfer belt 14 is kept the same as at the primary transfer, and the distribution of the toner T is maintained.

Figure 5B:
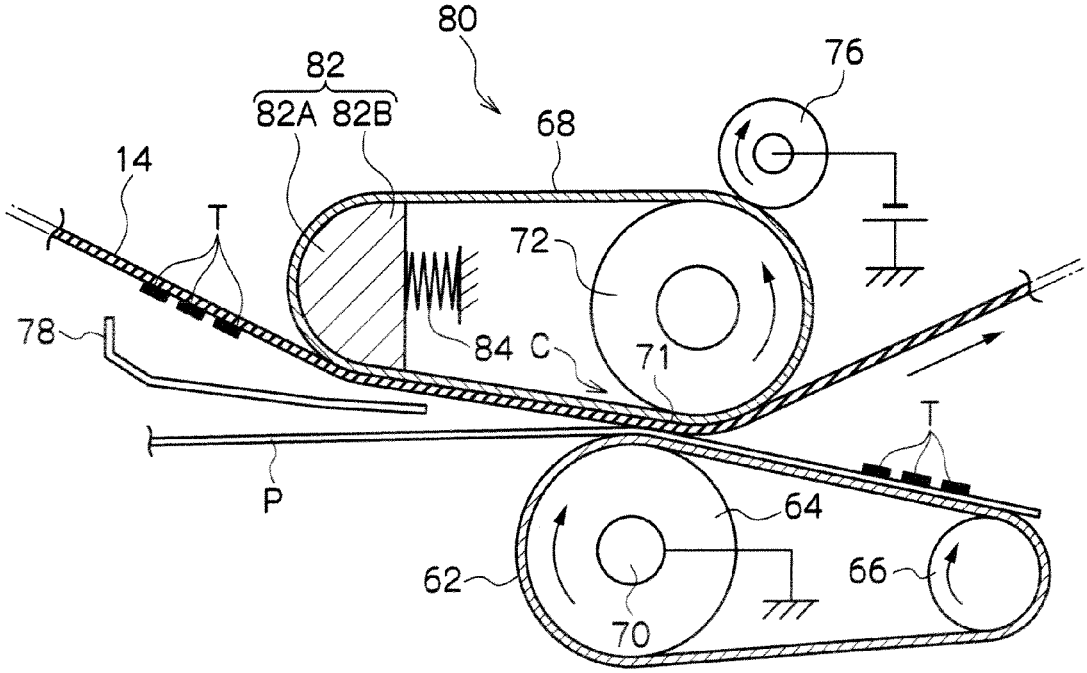

Subsequently, as shown in FIG. 5B, the recording paper P enters the contact portion 71 of the following roller 72 and the transfer roller 64. Electrostatic attractive force acts on the toner T due to the secondary transfer electric field between the following roller 72 and the transfer roller 64, and the toner T is secondary-transferred from the intermediate transfer belt 14 onto the recording paper P. The image of toner on the recording paper P is present at the original locations at which the toner T was intended to be disposed, and scale-form irregularities are barely measurable.

Now, the present invention is not limited to the exemplary embodiments described above.

As long as the printer 10 employs the intermediate transfer belt 14, it may be a revolver-type printer that performs development on a single photosensitive body with plural developing units. Further, a resistance layer with similar resistance to the transfer conveyance belt 62 may be formed at the surface of the transfer roller 64 and caused to touch against the intermediate transfer belt 14, as a single transfer roller.

Furthermore, in place of the charging roller 76, a rod-form fixed electrode member may be touched against the opposing belt 68, within a scope in which there is no effect from sliding friction against the opposing belt 68. Further still, for application of the secondary transfer bias, the transfer roller 64 may be not earthed and a voltage may be applied to put the transfer roller 64 at a higher potential than the following roller 72.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to utilize the invention for various exemplary embodiments and with the various modifications as are suited to the particular use contemplated. It is intended that the scope of the invention be defined by the following claims and their equivalents.

What is claimed is:

1. A transfer apparatus comprising:

a transfer belt that conveys a toner image which has been transferred to an outer periphery face thereof;

a transfer member that, at a contact portion, causes the toner image to be transferred from the outer periphery face of the transfer belt to a recording medium;

an opposing roller that is disposed to oppose the transfer member at an inner periphery side of the transfer belt;

an opposing belt that is wound round the opposing roller;

a charging member that is provided at the opposing belt and charges the opposing roller; and a tension member that is disposed at an upstream side of a conveyance direction of the transfer belt relative to the opposing roller, the opposing belt being wound round the tension member, and the tension member causing the opposing belt to touch against the inner side of the transfer belt at the upstream side relative to the contact portion.

2. The transfer apparatus of claim 1, further comprising a spring member that urges the tension member toward the opposing belt.

3. The transfer apparatus of claim 1, wherein the tension member comprises a first tension roller that turns following the opposing belt.

4. The transfer apparatus of claim 1, wherein the transfer member comprises:

a transfer roller arranged to oppose the opposing roller;

a second tension roller arranged at a downstream side of a conveyance direction of the recording medium relative to the transfer roller; and a transfer conveyance belt that is wound round the transfer roller and the second tension roller, and that touches against the transfer belt at the contact portion.

5. The transfer apparatus of claim 1, wherein a surface resistivity of the transfer belt is at least $1\times10^{12}$ (Ω/sq.), and a surface resistivity of the opposing belt is lower than the surface resistivity of the transfer belt.

6. The transfer apparatus of claim 1, wherein the transfer belt comprises an elastic member.

7. An image forming device comprising:

the transfer apparatus according to claim 1;

a conveyance unit that conveys the recording medium to the transfer apparatus; and a control unit that controls application of voltage to the transfer member and causes the toner image to be transferred from the transfer belt to the recording medium.

8. The image forming device of claim 7, further comprising a spring member that urges the tension member toward the opposing belt.

9. The image forming device of claim 7, wherein the tension member comprises a first tension roller that turns following the opposing belt.

10. The image forming device of claim 7, wherein the transfer member comprises:

a transfer roller arranged to oppose the opposing roller;

a second tension roller arranged at a downstream side of a conveyance direction of the recording medium relative to the transfer roller; and a transfer conveyance belt that is wound round the transfer roller and the second tension roller, and that touches against the transfer belt at the contact portion.

11. The image forming device of claim 7, wherein a surface resistivity of the transfer belt is at least $1\times10^{12}$ (Ω/sq.), and a surface resistivity of the opposing belt is lower than the surface resistivity of the transfer belt.

12. The image forming device of claim 7, wherein the transfer belt comprises an elastic member.

* * * * *